US009179792B2

(12) United States Patent
Harding et al.

(10) Patent No.: US 9,179,792 B2
(45) Date of Patent: Nov. 10, 2015

(54) DISPENSER ASSEMBLY

(71) Applicants: Beverly Harding, Las Vegas, NV (US); Robert Harding, Las Vegas, NV (US)

(72) Inventors: Beverly Harding, Las Vegas, NV (US); Robert Harding, Las Vegas, NV (US)

( * ) Notice: Subject to any disclaimer, the term of this patent is extended or adjusted under 35 U.S.C. 154(b) by 242 days.

(21) Appl. No.: 13/939,310

(22) Filed: Jul. 11, 2013

(65) Prior Publication Data

US 2015/0014494 A1 Jan. 15, 2015

(51) Int. Cl.

| | |
|---|---|
| ***A47J 47/16*** | (2006.01) |
| ***A47G 29/08*** | (2006.01) |
| ***A47G 23/02*** | (2006.01) |
| ***A47L 13/30*** | (2006.01) |
| ***A46B 17/02*** | (2006.01) |
| ***A45D 34/00*** | (2006.01) |

(52) U.S. Cl.

CPC ..... *A47G 29/08* (2013.01); *A45D 34/00* (2013.01); *A46B 17/02* (2013.01); *A47G 23/0241* (2013.01); *A47L 13/30* (2013.01); *A45D 2034/002* (2013.01)

(58) Field of Classification Search

CPC ..... A47G 29/08; A47G 23/0241; A47F 7/28; A45C 11/00; A47L 13/30; A46B 17/02; A45D 34/00

USPC ..... 248/176.1, 176.3, 309.1, 688, 133, 143, 248/274.1, 110, 139; 401/48, 118, 131; 15/167.3; 206/15.2, 361; 211/208

See application file for complete search history.

(56) References Cited

U.S. PATENT DOCUMENTS

| | | | | |
|---|---|---|---|---|
| 301,954 | A * | 7/1884 | Brand | B65G 65/24 248/142 |
| 711,339 | A * | 10/1902 | Park | A47G 23/0241 248/141 |
| 3,964,709 | A * | 6/1976 | LaBelle | A45D 34/00 211/73 |
| 5,141,188 | A * | 8/1992 | DeBlasi | A45D 34/00 248/137 |
| 5,425,460 | A * | 6/1995 | Barbarian | A47B 49/00 211/129.1 |
| 8,011,622 | B1 * | 9/2011 | Guthrie | B65G 65/24 224/164 |
| 8,313,261 | B1 * | 11/2012 | Mah | A46B 17/02 248/139 |
| 2012/0111875 | A1 * | 5/2012 | Johnson | A47G 23/0216 220/629 |

* cited by examiner

*Primary Examiner* — Todd M Epps

(57) ABSTRACT

A dispenser assembly secures an object, such as a bottle of nail polish, within a tilting repository at an orientation and angle efficacious for accessing the object with one hand. Pressure applied to the repository tilts it to a desired angle for facilitated access and manipulation of the object. After the pressure is removed, the center of gravity for the repository and object is met, and the repository returns to its starting position prior to receiving the exerted force. A bracket portion provides a support for the assembly. Sidewalls that extend form a base in the bracket portion include slots. The repository portion includes rods that slide into the slots, thereby forming a cradle. The repository may then tilt in response to an exerted force applied to the object in the repository. A brace hinges up from the base to hold the repository at a desired angle.

20 Claims, 6 Drawing Sheets

DISPENSER ASSEMBLY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to dispenser assemblies. More particularly, the invention relates to a dispenser assembly for holding and tilting an object being accessed.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that nail polish is a lacquer applied to human finger or toe nails to decorate and protect the nail plate. Nail polish may include a refined version similar to the paint on vehicles.

Typically, a bottle is a rigid container with a neck that is narrower than the body and a mouth. Bottles are often made of glass, clay, plastic, aluminum, or other impervious materials, and typically used to store liquids, powders, or slurries.

It is known that, the center of gravity is the point in a body around which the resultant torque due to gravity forces vanishes. Near the surface of the earth, where the gravity acts downward as a parallel force field, the center of gravity and the center of mass are the same.

Often, accessing a bottle of nail polish with one hand can result in accidents from misbalancing the bottle or waste from spillage, since the second hand is not available to serve as a brace. Also, the bottle may slide along a ground surface, which makes accessing the bottle more difficult.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates an exemplary bracket portion joined with an exemplary repository portion, and FIG. 2B illustrates an exemplary bracket portion separated from an exemplary repository portion, in accordance with an embodiment of the present invention;

FIG. 3A illustrates an exemplary tall object positioned inside an exemplary repository portion, FIG. 3B illustrates an exemplary short object positioned inside an exemplary repository portion, and FIG. 3C illustrates an exemplary bracket portion tilted at an angle, in accordance with an embodiment of the present invention;

Figure 1:
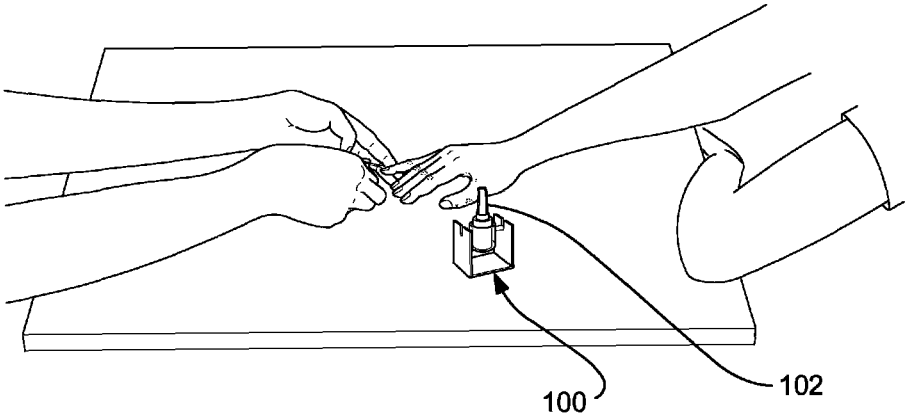
FIG. 1 illustrates a detailed perspective view of an exemplary dispenser assembly in use, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The present invention will now be described in detail with reference to embodiments thereof as illustrated in the accompanying drawings.

There are various types of dispenser assemblies that may be provided by preferred embodiments of the present invention. In one embodiment of the present invention, the dispenser assembly may secure an object within a tilting repository at an orientation and angle efficacious for accessing the object with one hand. Pressure applied to the repository may tilt it to a desired angle for facilitated access and manipulation of the object. After the pressure is removed, the center of gravity for the repository and object is met, and the repository returns to its starting position prior to receiving the exerted force.

In one embodiment of the present invention, the dispenser assembly includes a tilting repository configured to hold a container of nail polish. The dispenser assembly secures firmly to a ground surface while the container tilts to a desired angle. In this manner, a composition inside the container may be accessed and manipulated from a desired angle and orientation with one hand. For example, without limitation, a nail polish container may position inside the dispenser assembly. One hand may access and manipulate the nail polish inside the container, while simultaneously tilting the container to a desired angle and orientation. A grip on the bottom surface of the dispenser assembly helps secure the dispenser assembly while the container is being accessed. After accessing the container, the hand may be removed, and the container center of gravity returns the container to a starting position prior to the force exerted by the hand. In some embodiments, the dispenser assembly may include a motion detector that tilts in response to an object in proximity to the container.

The dispenser assembly includes a bracket portion for providing support and a foundation. In some embodiments, the bracket portion may be utilized as support for a tilting mechanism, including without limitation, a cradle, a rocker, and a pivoting suspension device. The bracket portion includes a base that engages a ground surface. The base may include a base surface having a texture efficacious for gripping a ground surface. In this manner, the dispenser assembly may remain firmly affixed to the ground surface while pressure is applied to the repository, or while the repository rocks. In some embodiments, at least one sidewall extends upwardly from the base, in a substantially vertical orientation. The at least one sidewall may include a base end that joins the base. The at least one sidewall may further include a mounting end. The mounting end may include a slot for providing the tilting function to the dispenser assembly. The slot may include a radial opening at a top end for providing facilitated access.

In one embodiment of the present invention, the dispenser assembly may include a repository portion for tilting on the bracket portion and holding the object. The repository portion may be configured to receive the object without allowing the object to overturn. At least one guide on an interior surface of the repository portion may help guide the object inside the repository portion. In some embodiments, the repository portion may include at least one rod that extends outwardly. The at least one rod may include a proximal end that joins with the repository portion. The at least one rod may further include a distal end configured to at least partially fit into the slot in the at least one sidewall. Each rod may be operable to pivot within each slot, thereby allowing the repository portion to tilt. The distal end may include a reduced diameter at a terminal section of the distal rod. The reduced diameter may form a ridge that presses flush against the at least one sidewall. The ridge may help secure the cradle into the slot, and also help prevent an external force from detaching the repository portion from the bracket portion. In this manner, the repository portion with the container inside may pivot freely upon pressure from a force, and return to a starting position after the force is removed.

FIG. 1 illustrates a detailed perspective view of an exemplary dispenser assembly in use, in accordance with an embodiment of the present invention. In the present embodiment, a dispenser assembly 100 may provide a secure, rocking mechanism the holds a container of nail polish and allows the nail polish to be accessed and manipulated form a variety of angles due to the rocking motion and various angles from which the nail polish may be accessed. The dispenser assembly may secure an object 102 within a tilting repository at an orientation and angle efficacious for accessing a product inside the repository with one hand. Pressure applied to the repository may tilt it to a desired angle for facilitated access and manipulation of the object. After the pressure is removed, the center of gravity for the repository and the object is met, and the repository returns to its starting position prior to receiving the exerted force. The object may include, without limitation, nail polish bottle, nail polish remover bottle, paint, decorative compositions, makeup, tobacco, medicine, drugs, jewelry, technology components, adhesives, and any other object sized and dimensioned to fit inside the cradle. In some embodiments, the object may not require a container. For example, without limitation, a pile of eyeliner powder in the bottom of the repository portion.

In one embodiment of the present invention, the dispenser assembly includes a tilting repository configured to hold a container of nail polish. The dispenser assembly secures firmly to a ground surface while the container tilts to a desired angle. In this manner, the object may be accessed and manipulated from a desired angle and orientation with only one hand. For example, without limitation, a nail polish container may position inside the dispenser assembly. One hand may access and manipulate the nail polish inside the dispenser assembly, while simultaneously tilting the dispenser assembly to a desired angle and orientation. A grip on the bottom surface of the dispenser assembly helps secure the dispenser assembly while the container of nail polish is being accessed. After accessing the container, the hand may be removed, and the container center of gravity returns the container to a starting position prior to the force exerted by the hand. In essence, when the polish is not being accessed it sits upright in the repository portion, but when the polish is grasped by the cap or brush of the polish, the repository portion may tilt to allow facilitated removal of the brush. In this manner, waste and spills may be minimized.

Figure 2A:
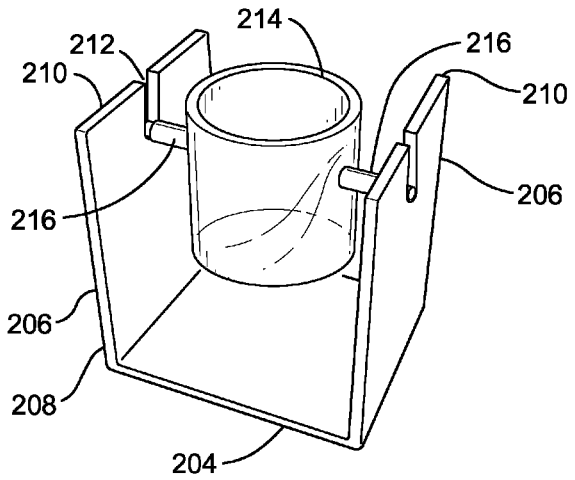
FIGS. 2A and 2B illustrate detailed perspective views of exemplary dispenser assemblies, where
Figure 2B:
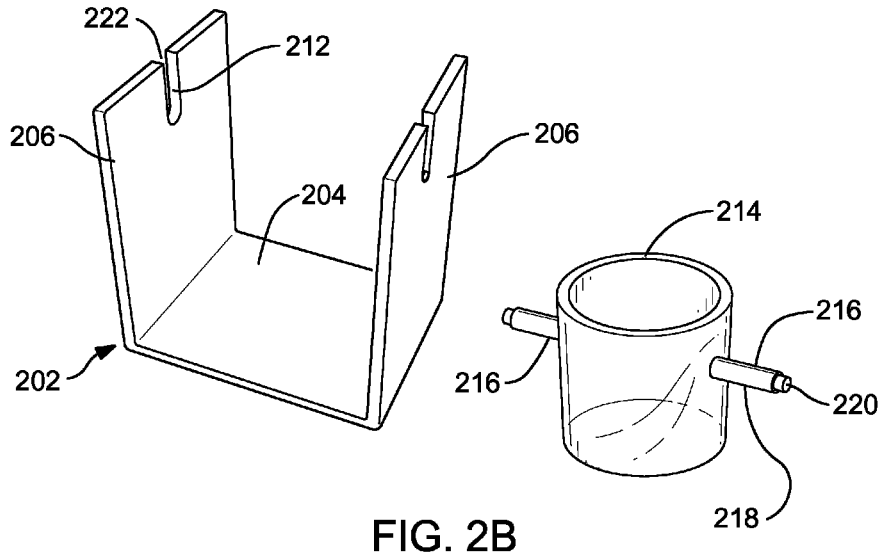

FIGS. 2A and 2B illustrate detailed perspective views of exemplary dispenser assemblies, where FIG. 2A illustrates an exemplary bracket portion joined with an exemplary repository portion, and FIG. 2B illustrates an exemplary bracket portion separated from an exemplary repository portion, in accordance with an embodiment of the present invention. In the present embodiment, the dispenser assembly includes a bracket portion 202 for providing support and a foundation to the object. In some embodiments, the bracket portion may be utilized as support for a tilting mechanism, including without limitation, a cradle, a rocker, and a pivoting suspension device. The bracket portion includes a base 204 that engages a ground surface. In one embodiment, the base may include, without limitation, a rigid, 3"×2½" rectangle. The base may include a base surface having a texture efficacious for gripping a ground surface. In this manner, the dispenser assembly may remain firmly affixed to the ground surface while pressure is applied to the repository portion, or while the repository portion rocks. In some embodiments, at least one sidewall 206 extends upwardly from the base, in a substantially vertical orientation. The at least one sidewall may include a base end 208 that joins the base. The at least one sidewall may further include a mounting end 210. In one embodiment, the base may include, without limitation, a rigid, 3"×2½" rectangle. The mounting end may include a slot 212 for providing the tilting function to the dispenser assembly. The slot may include a radial opening 222 at a top end for providing facilitated access. In one embodiment, the slot may include a ¾" length and a ¼" width. However, in other embodiments, additional sizes and dimensions may be utilized.

In one embodiment of the present invention, the dispenser assembly may include a repository portion 214 for tilting on the bracket portion and holding the object. The repository portion may be configured to receive the object without allowing the object to overturn. At least one guide on an interior surface of the repository portion may help guide the object inside the repository portion. In some embodiments, the repository portion may include at least one rod 216 that extends outwardly. The at least one rod may include a proximal end 218 that joins with the repository portion. The at least one rod may further include a distal end 220 configured to at least partially fit into the slot in the at least one sidewall. Each rod may be operable to pivot within each slot, thereby allowing the repository portion to tilt. In one embodiment, the repository portion may be sized at a 2" length, 2" outer diameter, and 1½" inner diameter. Suitable materials for the repository portion may include, without limitation, high density polyethylene, polymers, fiberglass, glass, metal, and wood.

In one embodiment of the present invention, the distal end may include a reduced diameter at a terminal section of the distal rod. The reduced diameter may form a ridge that presses flush against the at least one sidewall. The ridge may help secure the repository portion into the slot, and also help prevent an external force from detaching the repository portion from the bracket portion. In this manner, the repository portion with the object inside may pivot freely upon pressure from a force, and return to a starting position after the force is removed. In one embodiment of the present invention, the dispenser assembly may separate into two separate pieces for enhanced cleaning. The repository portion and the bracket portion may separate by lifting the at least one rod through the slot. However, in other embodiments, the repository portion may be permanently joined with the bracket portion.

Figure 3A:
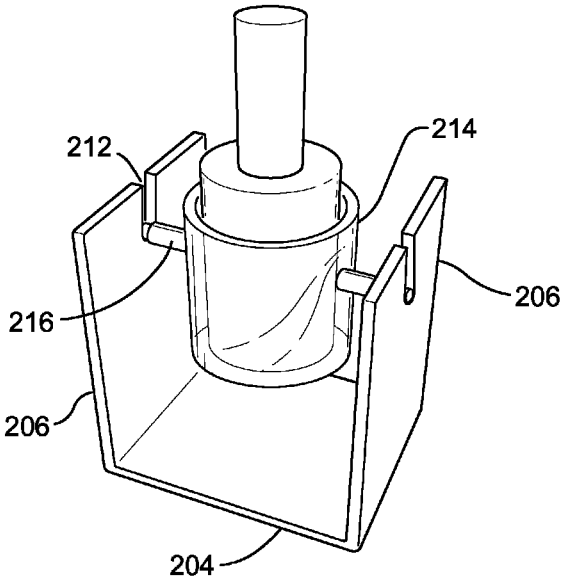
FIGS. 3A, 3B, and 3C illustrate detailed perspective views of exemplary dispenser assemblies, where
Figure 3B:
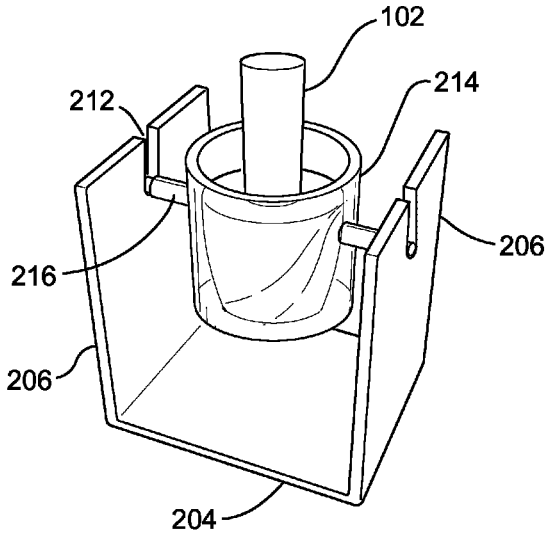
Figure 3C:
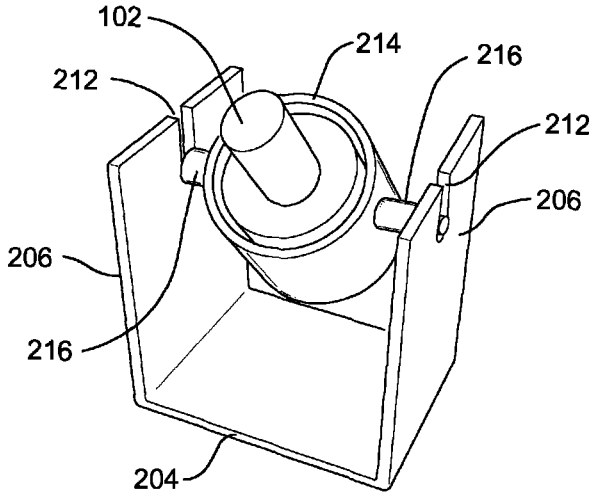

FIGS. 3A, 3B, and 3C illustrate detailed perspective views of exemplary dispenser assemblies, where FIG. 3A illustrates an exemplary tall object positioned inside an exemplary repository portion, FIG. 3B illustrates an exemplary short object positioned inside an exemplary repository portion, and FIG. 3C illustrates an exemplary bracket portion tilted at an angle, in accordance with an embodiment of the present invention. In the present embodiment, the repository portion may be sized and dimensioned to accept an eclectic assortment of objects, including, without limitation, nail polish bottles, paint, decorative compositions, makeup, tobacco, medicine, drugs, jewelry, and technology components. The repository portion may include a cylindrical shape. However, in other embodiments, the repository portion may include, without limitation, a cube, a pyramid, a rectangle, and a sphere. In some embodiments, an open end of the repository portion may be configured to at least partially receive the objects, and a perimeter wall may have a diameter sufficient to receive variously sized makeup containers. In yet another embodiment, a basket may have various geometric shapes for containing an eclectic assortment of objects.

Those skilled in the art, in light of the present teachings, will recognize that tilting the object may provide enhanced access. Especially for a container holding a composition of matter. The repetitive force applied to the container during accessing and manipulation may be enhanced from a specific angle. After the container is accessed, the repository portion returns to a point around which the resultant torque due to gravity forces vanishes. This point, or center of gravity, allows the repository portion and the object to return to the starting position after being accessed. In this manner, the container may be accessed with one hand since the container is not only being held, but also sufficiently mobile to allow access from a variety of angles.

Figure 4:
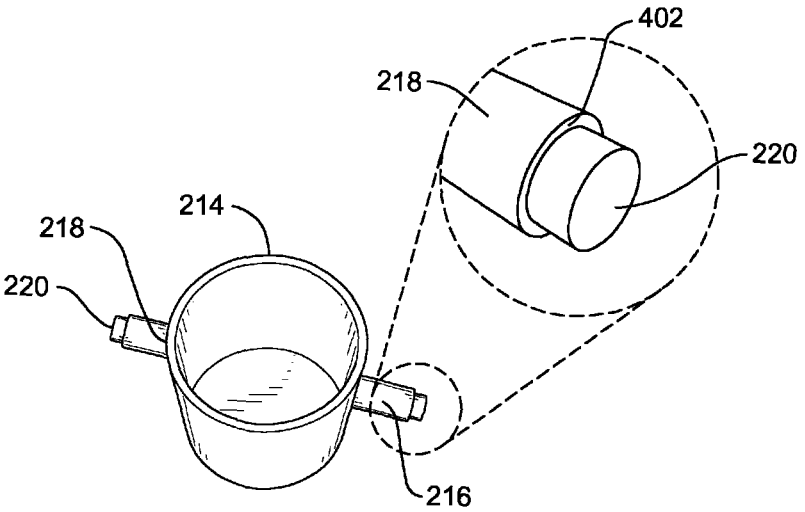
FIG. 4 illustrates a blowup view of an exemplary at least one rod, in accordance with an embodiment of the present invention.

FIG. 4 illustrates a blowup view of an exemplary at least one rod, in accordance with an embodiment of the present invention. In the present embodiment, the repository portion may include at least one rod that extends outwardly. The at least one rod may include a proximal end that joins with the repository portion. The at least one rod may extend from opposite points on an exterior of the at least one sidewall, and measure ⅝ in total length. The at least one rod may further include a distal end configured to at least partially fit into the slot in the at least one sidewall. Each rod may be operable to pivot within each slot, thereby allowing the repository portion to tilt. The distal end may include a reduced diameter at a terminal section of the distal rod. In one embodiment, the diameter of the at least one rod may reduce from ⅜" to ¼". The reduced diameter may form a ridge 402 that presses flush against the at least one sidewall. The ridge may help secure the cradle into the slot, and also help prevent an external force from detaching the repository portion from the bracket portion. In this manner, the repository portion with the object inside may pivot freely upon pressure from a force, and return to a starting position after the force is removed.

Figure 5:
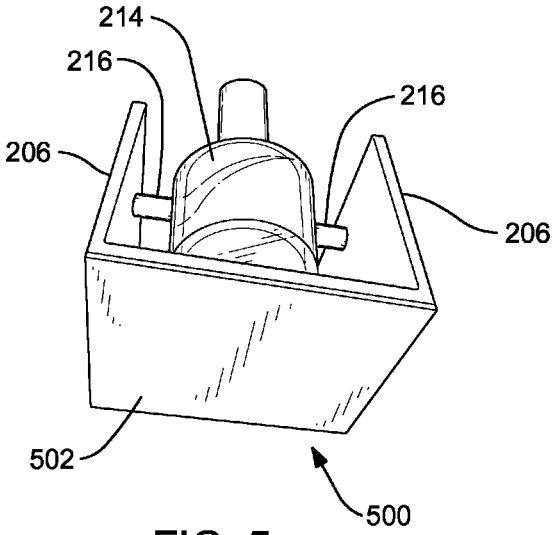
FIG. 5 illustrates a bottom view of an exemplary base mounting surface having an exemplary grip portion, in accordance with an embodiment of the present invention.

FIG. 5 illustrates a bottom view of an exemplary base mounting surface having an exemplary grip portion, in accordance with an embodiment of the present invention. In the present embodiment, the base may include a horizontal plane configured to rest flush against the ground surface. A base mounting surface 500 may engage the ground surface. A gripping portion 502 may join with the base mounting surface for enhanced gripping to the ground surface. The gripping portion may include, without limitation, a textured rubber coating, an adhesive, a magnet, and fasteners. Those skilled in there art, in light of the present teachings, will recognize that the assembly may be mounted on a vertical surface to help conserve space, whereby a weight may help orient the container relative to the diction of the wall.

Figure 6:
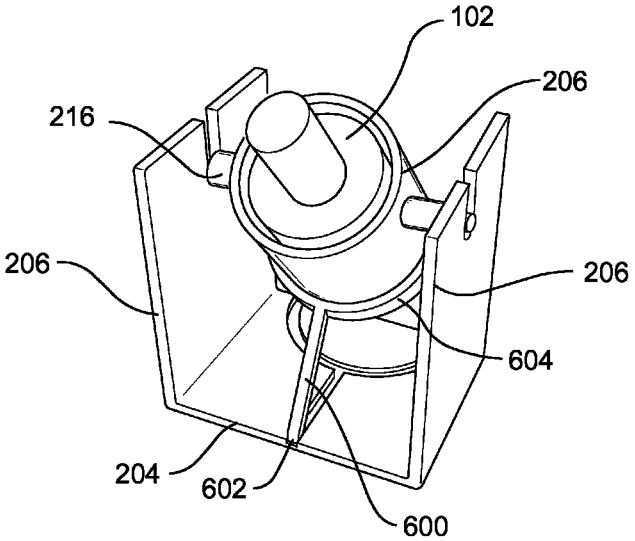
FIG. 6 illustrates a detailed perspective view of an exemplary brace supporting an exemplary repository portion at an angle, in accordance with an embodiment of the present invention.

FIG. 6 illustrates a detailed perspective view of an exemplary brace supporting an exemplary repository portion at an angle, in accordance with an embodiment of the present invention. In the present embodiment, the dispenser assembly may include a brace portion 600 for locking the repository portion into a desired angle. In this manner, the repository portion may remain in the desired angle, even when the exerted force is removed. The brace portion may include a flat rod that positions along a central area of the base. The brace portion may position inside a recess in the base for storage. In some embodiments, the brace portion may pivot up from a brace proximal end 602 that joins with the base to engage the repository portion. A brace distal end 604 may join the repository portion at an angle efficacious for securing the repository portion in place. The brace may then provide a support member that extends from the base and the repository portion to hold the repository portion at the desired angle.

Figure 7:
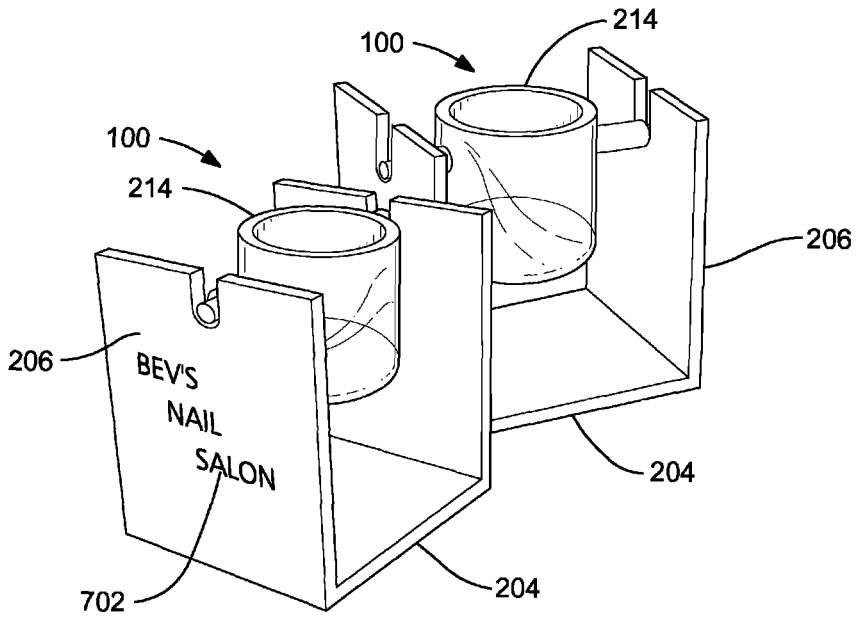
FIG. 7 illustrates a detailed perspective view of exemplary dispenser assemblies having exemplary indicia on the at least one sidewall, in accordance with an embodiment of the present invention.

FIG. 7 illustrates a detailed perspective view of exemplary dispenser assemblies having exemplary indicia on the at least one sidewall, in accordance with an embodiment of the present invention. In the present embodiment, the dispenser assembly may provide commercial embodiments. For example, without limitation, indicia 702 may position on an exterior surface of each sidewall. The indicia may read, without limitation, "Bev's Nail Salon". However, in other embodiments, the indicia may include graphics, video, audio signals, various textures, and various colors.

In one alternative embodiment, the assembly includes a motion detector that operatively tilts in response to a hand and pressure applied by the hand. In yet another alternative embodiment, the bracket itself is angled and tilts in response to an exerted force applied to the object. In another alternative embodiment, the repository portion includes a perimeter rim for catching spilled nail polish. In yet another alternative embodiment, a plurality of nail polish bottles may be accessed from a tilting circular dispenser that still includes rods that fit into the slots of the bracket portion. In this manner, the assembly may be tilted and rotated simultaneously for increased options.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a tilting container for accessing and manipulating an object with one hand according to the present invention will be apparent to those skilled in the art. Various aspects of the invention have been described above by way of illustration, and the specific embodiments disclosed are not intended to limit the invention to the particular forms disclosed. The particular implementation of the tilting container for accessing and manipulating an object with one hand may vary depending upon the particular context or application. By way of example, and not limitation, the tilting container for accessing and manipulating an object with one hand described in the foregoing were principally directed to a repository that held a nail polish bottle, and formed a cradle with a bracket portion; however, similar techniques may instead be applied to accessing liquids with a straw for drinking in a race car during high velocities at inclined angles, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An assembly comprising:

a bracket portion, said bracket portion being configured to support said assembly, said bracket portion comprising:

a base segment, said base segment being configured to engage a ground surface;

a base mounting surface, said base mounting surface being disposed at said base segment, said base mounting surface having a texture efficacious for gripping said ground surface;

a grip portion, said grip portion disposed on said base mounting surface, said grip portion being operable to at least partially adhere to said ground surface;

a sidewall section, said sidewall section comprising at least two proximately rectangular sidewall sections, said sidewall section being disposed to extend upwardly from said base segment in a proximate vertical orientation;

a base end section, said base end section comprising at least two base end sections, said base end section being disposed to engage with said base segment;

a mounting end section, said mounting end comprising at least two mounting end sections, said mounting end section disposed at a proximate top end portion of said sidewall section, said mounting end section is configured to provide a tilting function; and a slot segment, said slot segment comprising at least two slot segments, said slot segment being disposed at said mounting end section, wherein said slot segment being configured with at least a radial opening part;

a repository portion, said repository portion comprising a detachable repository portion operable for enhanced cleaning, said repository portion further comprising at least a body with a closed bottom end portion and an open top end portion, said open top end portion being configured to receive an object, in which said object comprising at least one of a nail polish container, nail polish bottle, nail polish remover bottle/container, paint bottle/container, decorative compositions, makeup, tobacco, medicine, drugs, jewelry, technology components and adhesives, wherein said repository portion being operable to tilt on said bracket portion and hold said object;

a rod section, said rod section comprising at least two proximately round rod sections, said rod section being disposed to extend outwardly from opposite sides of said repository portion, said rod section being configured to at least partially position into said slot segment, said rod section being operable to form a pivot point for tilting said repository portion in relation to said bracket portion;

a proximal end part, said proximal end part is disposed at one end of said rod section, said proximal end part is configured to engage with said repository portion;

a distal end segment, said distal end segment is disposed at a proximate terminal end section of said rod section, said distal end segment comprising at least two distal end segments with reduced diameter at said terminal end section being configured to fit in said slot segment;

a ridge part, said ridge part is disposed at said terminal end section, said ridge part is configured to press flush against said sidewall section, said ridge part is further configured to secure said repository portion into said slot segment and substantially prevent an external force from detaching said repository portion from said bracket portion, said repository portion being operable to substantially pivot freely upon pressure from said external force and return to a starting position after said external force is removed; and a material composition, said material composition comprising at least one of a high density polyethylene, polymers and fiberglass, wherein said repository portion is made of said material composition.

2. The assembly of claim 1, in which said bracket portion is configured to help support a cradle.

3. The assembly of claim 1, in which said grip portion comprising at least one of a textured rubber coating, an adhesive, a magnet, and fasteners.

4. The assembly of claim 1, further comprises a brace portion, said brace portion is operable to provide a support member that extends from said base segment and said repository portion to hold said repository portion at a predetermined angle.

5. The assembly of claim 4, wherein said brace comprises a flat rod that positions along a proximate central area of said base segment.

6. The assembly of claim 4, wherein said brace portion further comprises a brace distal end segment, wherein said brace distal end segment is operable to engage said repository portion for holding said repository portion in a tilted position.

7. The assembly of claim 1, in which said repository portion further comprising at least a cube shape repository portion having a closed end portion and an open end portion for receiving said object.

8. The assembly of claim 1, in which said material composition further comprising at least one of a glass, metal, and wood.

9. The assembly of claim 1, in which said slot is disposed to orient along a longitudinal axis of said mounting end.

10. The assembly of claim 1, in which said slot comprises a radius shape at a top entry portion.

11. The assembly of claim 1, in which said repository portion comprises a substantially circular container configured to hold a nail polish bottle.

12. The assembly of claim 1, in which said repository portion comprises at least one guide, said at least one guide being disposed to align a longitudinal axis of an interior surface, said at least one guide being operable to guide said object into said repository portion.

13. The assembly of claim 1, further comprising at least an indicia marking, said indicia marking being disposed on an exterior surface of said at least two sidewalls.

14. The assembly of claim 13, in which said indicia marking comprises at least one of a graphics, video, audio signal, various textures, and various colors.

15. The assembly of claim 1, in which said repository portion further comprising a perimeter rim operable for catching spilled nail polish.

16. The assembly of claim 1, in which said repository portion further comprising at least a pyramid shape body with a closed bottom end portion and an open top end portion for receiving said object.

17. The assembly of claim 1, in which said detachable repository portion further comprising at least a cylindrical shape body having a closed bottom end portion and an open top end portion for receiving said object.

18. The assembly of claim 1, in which said repository portion further comprising at least a proximate rectangle shape body having a closed bottom end portion and an open top end portion for receiving said object.

19. An assembly comprising:

means for receiving, said receiving means comprising a detachable receiving means, said receiving means further comprising a body with a closed bottom end portion and an open top end portion, said open top end portion being configured to receive an object, in which said object comprising at least one of a nail polish container, nail polish bottle, nail polish remover bottle/container, paint bottle/container, decorative compositions, makeup, tobacco, medicine, drugs, jewelry, technology components and adhesives;

means for supporting said receiving means, said supporting means comprising a means for gripping a ground surface, said supporting means further comprising at least two proximately rectangular sidewall sections, wherein said receiving means being operable to tilt on said supporting means and hold said object;

means for joining, said joining means comprising at least two joining means for joining said receiving means to said supporting means, said joining means comprising a ridge part configured to press flush against said sidewall section, wherein said ridge part is further configured to secure said receiving means into said supporting means and substantially prevent an external force from detaching said receiving means from said supporting means;

means for positioning an object inside said receiving means;

means for applying a force on said object;

means for tilting said object for facilitated access to said object;

means for removing said force from said object; and means for returning said object to a starting position.

20. A system consisting of:

a bracket portion, said bracket portion being configured to help support a cradle, said bracket portion further being configured to support said system, said bracket portion comprising a base, said base being configured to engage a ground surface, said base comprising a base mounting surface, said base mounting surface comprising a grip portion, said grip portion being operable to at least partially adhere to said ground surface, said bracket portion further comprising at least a sidewall, said sidewall comprising two proximately rectangular shape and vertical sidewalls, said sidewall further comprising a base end, said base end being disposed to extend from said base, said sidewall further comprising a mounting end, said mounting end comprising a slot, said slot being disposed to orient along a longitudinal axis of said mounting end, said slot comprising a radius shape at a top entry portion;

a repository portion, said repository portion comprising a substantially circular and detachable container, said repository portion and bracket are separable for enhanced cleaning, said repository portion comprising at least a body with a closed bottom end portion and an open top end portion, said repository open top end portion being configured to receive an object, said repository portion comprising at least one guide for guiding said object into said repository portion, said object comprising a nail polish bottle comprising nail polish, said repository portion comprising at least a rod, said rod comprising at least two rods disposed to extend in a substantially horizontal orientation from said repository portion, said rod comprising a distal end segment with reduced diameter at said terminal end section being configured to fit in said slot, said rod further comprising a ridge part disposed at said terminal end section, said ridge part is configured to press flush against said vertical sidewalls, wherein said rod being configured to at least partially position into said slot, said rod being operable to form a pivot point for tilting said repository portion and said object in relation to said bracket portion;

a material composition, said material composition comprising at least one of a glass, metal, and wood, wherein said repository portion is made of said material composition; and a brace, said brace being disposed to position on said base, said brace being operable to extend from said brace, said brace being configured to hold said repository portion and said object in a tilted position.

* * * * *